US010364519B2

(12) United States Patent
Schneider et al.

(10) Patent No.: US 10,364,519 B2
(45) Date of Patent: Jul. 30, 2019

(54) SLIDE SPRING, SLIDE, SLIDE NEEDLE, GUIDE ARRANGEMENT, AND METHOD FOR PRODUCING AT LEAST ONE SLIDE SPRING

(71) Applicants: Groz-Beckert KG, Albstadt (DE); Shima Seiki Manufacturing, Wakayama (JP)

(72) Inventors: Jürgen Schneider, Balingen (DE); Kuno Horn, Nusplingen (DE); Walter Matthes, Bitz (DE); Minoru Sonomura, Wakayama (JP)

(73) Assignees: Groz-Beckert KG, Albstadt (DE); Shima Seiki Manufacturing, Wakayama (JP)

( * ) Notice: Subject to any disclaimer, the term of this patent is extended or adjusted under 35 U.S.C. 154(b) by 0 days.

(21) Appl. No.: 15/566,492

(22) PCT Filed: Apr. 6, 2016

(86) PCT No.: PCT/EP2016/057501
§ 371 (c)(1),
(2) Date: Oct. 13, 2017

(87) PCT Pub. No.: WO2016/165991
PCT Pub. Date: Oct. 20, 2016

(65) Prior Publication Data

US 2018/0187349 A1 Jul. 5, 2018

(30) Foreign Application Priority Data

Apr. 14, 2015 (DE) ..... 10 2015 105 648

(51) Int. Cl.
*D04B 35/06* (2006.01)
*D04B 9/04* (2006.01)
(Continued)

(52) U.S. Cl.
CPC ..... *D04B 35/06* (2013.01); *D04B 9/04* (2013.01); *D04B 15/20* (2013.01); *D04B 27/06* (2013.01)

(58) Field of Classification Search
CPC ..... D04B 35/06; D04B 9/04; D04B 15/20; D04B 27/06
(Continued)

(56) References Cited

U.S. PATENT DOCUMENTS 5,097,683 A * 3/1992 Schuler ..... D04B 35/02 66/121
6,233,977 B1 * 5/2001 Schuler ..... D04B 35/06 66/120
6,422,045 B1 * 7/2002 Morita ..... D04B 35/06 66/120
6,807,831 B2 * 10/2004 Roth ..... D04B 35/02 66/123
(Continued)

FOREIGN PATENT DOCUMENTS

DE 10130365 C1 1/2003
DE 102013105239 A1 11/2014
(Continued)

OTHER PUBLICATIONS

European Patent Office; Search Report in International Patent Application No. PCT/EP2016/057501 dated Jun. 13, 2016; 4 pages.

*Primary Examiner* — Danny Worrell
(74) *Attorney, Agent, or Firm* — Dorton & Willis, LLP

(57) ABSTRACT

A slider spring for a slider used with a slider needle of a loop-forming textile machine includes a closing section for closing a hook opening of the slider needle, a connection section for connecting to a slider body, and a guide section for guiding the slider at a needle body. The slide spring includes at least one bead with a concave bead interior and a convex bead exterior. The slider spring is shaped and
(Continued)

configured to be stacked against at least one other slider spring such that the convex bead exterior of the slider spring fits completely within the respective concave bead interior of the at least one other slider spring. A slider for a slider needle includes first and second slider springs as described. A slider needle includes a slider displaceable in a needle longitudinal direction relative to a needle body for opening or closing a hook opening.

12 Claims, 3 Drawing Sheets

(51) Int. Cl.
*D04B 15/20* (2006.01)
*D04B 27/06* (2006.01)

(58) Field of Classification Search
USPC ..... 66/120, 123
See application file for complete search history.

(56) References Cited

U.S. PATENT DOCUMENTS

| | | | | |
|---|---|---|---|---|
| 6,912,875 | B2 * | 7/2005 | Fehrenbacher | D04B 37/00 66/1 R |
| 7,614,254 | B2 * | 11/2009 | Weihing | D04B 37/02 66/1 R |
| 7,836,729 | B2 * | 11/2010 | Kirchmair | D04B 35/04 66/116 |
| 7,930,906 | B2 * | 4/2011 | Dietz | D04B 35/06 66/120 |
| 8,141,394 | B2 * | 3/2012 | Brandl | D04B 27/06 66/123 |
| 8,578,740 | B2 * | 11/2013 | Schneider | C23C 18/44 66/120 |

FOREIGN PATENT DOCUMENTS

| | | | |
|---|---|---|---|
| EP | 1270785 | A1 | 1/2003 |
| EP | 2581480 | A1 | 4/2013 |

* cited by examiner

SLIDE SPRING, SLIDE, SLIDE NEEDLE, GUIDE ARRANGEMENT, AND METHOD FOR PRODUCING AT LEAST ONE SLIDE SPRING

CROSS-REFERENCE

This application is a national phase application under 35 U.S.C. § 371 of International Patent Application No. PCT/EP2016/057501, filed Apr. 6, 2016 (pending), which claims the benefit of German Patent Application No. DE 10 2015 105 648.8 filed Apr. 14, 2015, the disclosures of which are incorporated by reference herein in their entirety.

TECHNICAL FIELD

The invention relates to a slider spring for a slider needle, with the slider spring comprising a closing section for closing a hook opening, a connecting section for connecting to a slider body, and a guide section for guiding at a needle body, with the slider spring extending in a spring longitudinal direction, in a spring transverse direction, and a spring height direction, with the slider spring comprising at least one bead with a concave bead interior and a convex bead exterior. Additionally, the invention relates to a slider for a slider needle, with the slider needle comprising a slider body, with the slider extending in a slider longitudinal direction, in a slider transverse direction, and in a slider height direction. Additionally, the invention relates to a slider needle for a loop-forming textile machine, with the slider needle comprising a needle body with a hook and a slider channel, with the hook comprising a hook opening, with the slider needle extending in a needle longitudinal direction, in a needle transverse direction, and in a needle height direction. Additionally, the invention relates to a guide arrangement for a loop-forming textile machine, with the guide arrangement comprising at least one needle channel for a slider needle, with at least one needle channel extending in a channel longitudinal direction, in a channel transverse direction, and in a channel height direction. Additionally, the invention relates to a method for producing at least one such slider spring.

BACKGROUND

A slider needle is known from DE 101 30 365 C1 for loop-forming textile machines, comprising a needle body, with its shaft carrying at one end a hook with a tip, with two slot walls being provided at said shaft parallel to each other, which limit between each other a slider slot, comprising a slider which is arranged in the slider slot in a displaceable fashion, and which comprises at least two slider springs, which with their free legs, pointing to the hooks, are bent away from each other such that their ends are not in contact with each other in order to, starting from a contact site, form a funnel open towards the hook, and with their legs pointing to the hooks tapering in a tapering section towards the respective end by way of the thickness of the slider springs, measured perpendicular to the slot walls, reducing towards the end in order to generate a slider needle, which allows high operating safety at low slider friction. The slider springs comprises a tapering section at their inside a longitudinally arranged recess for receiving the hook.

A slider needle is known from EP 2 581 480 A1 comprising a longitudinal needle body with two side walls arranged opposite to each other and comprising a slider channel, which is limited by a bottom, and which comprises a slider which is arranged in the slider channel such that it can be displaced along a slide direction, with at least one of the side walls comprising a channel guide recess with a guide area and with the slider spring, at least in the retracted state of the side wall, comprising a laterally bent section following the cam comprising an area following the cam, with the section following the cam being allocated to the channel guide recess, with the section following the cam comprising two or more deformations in order to provide a slider needle, which allows the production of slider needles with a particularly fine division. The slider comprises two slider springs which are symmetrical in reference to each other. The slider springs are each plane and contact each other, forming at one end a catching section aligned towards a hook.

A slider needle is known from DE 10 2013 105 239 A1 comprising a needle body, which comprises a shaft extending in a longitudinal direction, which continues in needle hook at an end serving for the formation of loops, with the needle hook adjacent to a hook tip comprising a hook end section with two hook side areas, which are arranged in a transverse direction at a distance from each other, with the transverse direction being aligned perpendicular to the longitudinal direction, comprising a slider, which is supported at the needle body and mobile towards the needle hook and away from said needle hook, with the slider comprising two slider blades, which comprise at their top respectively a machine support area, with the two slider blades comprising at the blade ends respectively an inner recess area, which jointly limit a hook recess allocated to the needle hook and open towards the front in the longitudinal direction such that the needle hook engages the hook recess in a machine stop position, with a gap being formed between the interior recess areas and the respectively allocated hook side areas, which comprises in the transverse direction a gap width that changes in a height direction, with the height direction being aligned perpendicular to the longitudinal direction and perpendicular to the transverse direction.

SUMMARY

The invention is based on the objective to improve the slider spring mentioned at the outset with regards to structure and/or function. Additionally, the invention is based on the objective to improve a slider mentioned at the outset with regards to structure and/or function. Furthermore, the invention is based on the objective to improve the slider needle mentioned at the outset with regards to structure and/or function. Additionally, the invention is based on the objective to improve the guide arrangement mentioned at the outset with regards to structure and/or design. Furthermore the invention is based on the objective to improve the method mentioned at the outset. In particular, the stiffness of the slider spring shall be increased. In particular the stiffness of the slider spring shall be increased about a bending axis extending in the spring height direction. In particular, the ability to guide inside a needle channel shall be improved. In particular, a more precise guidance shall be possible inside a needle channel. In particular, a support of the slider spring inside a needle channel shall be possible. In particular, a support of the slider spring inside a needle channel shall be possible when the hook opening is closed. In particular, a more precise loop formation shall be possible. In particular, the production of textiles shall be possible with an improved degree of fineness. In particular, load peaks shall be reduced. In particular, the operating time shall be increased. In particular, an expense, such as production expense, handling expense, storage expense, transportation expense, and/or logistics expense shall be reduced. In particular, the stacking of slider springs shall be enabled or facilitated. In particular, the stability of a stack of slider springs shall be increased. In particular, it shall be possible or facilitated to separate stacked slider springs.

The objective is attained with a slider spring for a slider, with the slider spring comprising a closing section for closing a hook opening, a connecting section for connecting to a slider body, and a guide section for guiding at a needle body, with the slider spring extending in a spring longitudinal direction, in a spring transverse direction, and in a spring height direction, with the slider spring comprising at least one bead with a concave bead interior and a convex bead exterior, allowing the slider spring to be stacked.

The bead interior and the bead exterior may comprise at least approximately similar cross-sectional contours. Similar cross-sectional contours may represent cross-sectional contours based on the same planar geometric figure. The bead interior and the bead exterior may respectively comprise a cross-sectional contour based on an arc. The arc may comprise at least sectionally a constant curvature. The arc may comprise sectionally different curvatures. The bead interior and the bead exterior may respectively comprise each an arc-like shaped cross-sectional contour. The bead interior may comprise an arc-shaped cross-sectional contour with a smaller radius and the bead exterior may comprise an arc-shaped cross-sectional contour with a greater radius. The slider spring may comprise at least sectionally a reduced material thickness at least at one bead in the spring transverse direction.

Slider springs with beads, which comprise different cross-sectional contours, cannot be stacked safely and in a stable fashion. Different cross-sectional contours may represent cross-sectional contours with are based on different planar geometric figures.

The spring longitudinal direction, the spring transverse direction, and the spring height direction may be perpendicular in reference to each other. The spring longitudinal direction, the spring transverse direction, and the spring height direction may be equivalent to the axial directions of a three-dimensional Cartesian coordinate system.

The slider spring may comprise a shape like a flat spring. The slider spring may essentially comprise a planar form. The slider spring may essentially extend in the spring longitudinal direction and the spring height direction.

The slider spring may comprise in the spring longitudinal direction an end at the hook side and at the end opposite the hook side an end at the connection side. The slider spring may comprise a bottom (in the) spring height direction and a top opposite the bottom.

The closing section may be arranged at the bottom. The closing section may be arranged at the hook-side end. The connecting section may be arranged at the end at the connecting side. The connecting section may be arranged at the top. The guide section may be arranged at the bottom. The guide section may be arranged at the end at the connecting side. The guide section may comprise a shape like runners.

The end at the hook side may serve to correspond with a hook tip in order to generate a contact for closing a hook opening. The slider spring may comprise at its hook-side end a cam-shaped form with an end flank. The slider spring may comprise a loop support section. The loop support section may be arranged adjacent to the end flank. The loop support section may extend essentially in the spring longitudinal direction. The slider spring may comprise a support flank. The support flank may be arranged adjacent to the loop support section. The support flank may essentially extend in the spring height direction. The slider spring may comprise an upper edge. The upper edge may be arranged adjacent to the support flank. The upper edge may face away from the closing section in the spring height direction. The upper edge may essentially extend in the spring longitudinal direction. The slider spring may comprise a recess. The recess may be arranged adjacent to the upper edge. The recess may be increased in the spring height direction. The slider spring may comprise a ramp section. The ramp section may be arranged adjacent to the recess. The end flank of the loop support section, the support flank, the upper edge, the recess, and/or the ramp section may be arranged at the top. The slider spring may comprise at its connecting section a lower edge in the spring height direction. The lower edge may essentially extend in the spring longitudinal direction. The slider spring may comprise in the spring transverse direction a spring interior and a spring exterior. The slider spring may be profiled and/or deformed in the spring transverse direction.

At least one bead may comprise a groove-like shape. At least one bead may extend in a bead longitudinal direction, in a bead transverse direction, and in a bead height direction. The bead longitudinal direction may be at least approximately equivalent to the spring longitudinal direction. At least one bead may be arranged in the spring height direction at least approximately in the area of the upper edge. At least one bead may be arranged at least approximately in the extension of the upper edge. At least one bead may be arranged at least approximately parallel to the upper edge. At least one bead may be arranged at least approximately coaxial in reference to the upper edge. At least one bead may be arranged in the spring height direction at least approximately in the area of the lower edge. At least one bead may be arranged at least approximately in the extension of the lower edge. At least one bead may be arranged at least approximately parallel to the lower edge. At least one bead may be arranged at least approximately coaxial in reference to the lower edge. At least one bead may be arranged in the spring height direction above the recess. The bead interior may be allocated to the spring interior. The bead exterior may be allocated to the spring exterior.

Sections of the slider spring adjacent to at least one bead in the spring height direction may be arranged at least approximately in parallel levels in the spring transverse direction. Sections of the slider spring adjacent to at least one bead in the spring height direction may be aligned at least approximately in the same levels in the spring transverse direction.

The slider springs may represent a punched and deformed part. The slider spring may be heat treated. The slider spring may be annealed. The slider spring may be tempered.

Additionally, the task underlying the invention is attained with a slider for a slider needle, with the slider needle comprising a slider body, with said slider extending in a slider longitudinal direction, in a slider transverse direction, and in a slider height direction, with said slider comprising a first such slider spring and a second such slider spring. The first slider spring and the second slider spring may be arranged with convex bead exteriors of their beads in the slider transverse direction pointing away from each other. The first slider spring and the second slider spring may be embodied in reference to each other at least approximately in a mirror-symmetrical fashion. The first slider spring and the second slider spring may be arranged with their beads parallel in reference to each other and distanced from each other.

The slider body may comprise in the slider longitudinal direction an end at the slider spring side. The slider springs may be connected with their connecting sections to a slider spring-side end. The slider springs and the slider body may be connected to each other in a force-fitting, form-fitting, and/or material-to-material bond. The slider springs and the slider body may be connected to each other through plastic deformation. The slider springs and the slider body may be connected to each other through caulking. The slider springs and the slider body may be connected to each other through elastic deformation. The slider springs and the slider body may be clipped to each other.

The end at the slider spring side may comprise in the slider height direction a bottom edge for guiding at a needle body. The beads of the slider springs may be arranged at least approximately in the area of the bottom edge in the slider height direction. The beads of the slider spring may be arranged at least approximately in the extension of the bottom edge. The beads of the slider springs may be arranged at least approximately parallel in reference to the bottom edge. The beads of the slider springs may be arranged at least approximately coaxial in reference to the bottom edge.

The slider may comprise at least one slider base. At least one slider base may be arranged at the slider body. At least one slider base may be aligned at least approximately in the slider height direction. At least one slider base may serve to engage a locking channel of a lock.

Additionally, the objective underlying the invention is attained in a slider needle for a loop-forming textile machine, with the slider needle comprising a needle body with a hook and a slider channel, with the hook comprising a hook opening, with the slider needle extending in a needle longitudinal direction, in a needle transverse direction, and in a needle height direction, with the slider needle comprising such a slider and the slider being displaceable in reference to the needle body for opening and/or closing the hook opening in the needle longitudinal direction.

The loop-forming textile machine may serve the industrial production of textiles. The loop-forming textile machine may represent a knitting machine. The knitting machine may be a circular knitting machine. The knitting machine may be a flatbed knitting machine. The loop-forming textile machine may be a hosiery machine. The loop-forming textile machine may comprise at least one needle channel for a slider needle. At least one needle channel may serve for receiving a slider needle in a displaceable fashion in the needle longitudinal direction. The loop-forming textile machine may comprise at least one cam. At least one cam may comprise at least one cam channel. At least one cam may be driven.

The hook may be curved. The hook may comprise a hook tip. The hook tip may serve to engage between the first slider springs and the second slider spring of a slider in order to close the hook opening.

The slider needle may comprise at least one needle base. At least one needle base may be arranged at the needle body. At least one needle base may be aligned at least approximately in the needle height direction. At least one needle base may serve to engage a lock channel of a lock.

The slider channel may be arranged adjacent to the hook. The slider may be guided with the guide sections of the slider spring in the slider channel in the needle longitudinal direction. In case of a closed hook opening the hook can engage with its hook tip between the first slider spring and the second slider spring of a slider and push apart the sliders springs in the needle transverse direction.

Additionally, the objective underlying the invention is attained in a guide arrangement for a loop-forming textile machine, with the guide arrangement comprising at least one needle channel or a slider needle, with at least one needle channel extending in a channel longitudinal direction, in a channel transverse direction, and in a channel height direction, with the guide arrangement comprising at least one such slider needle, and at least one slider needle being guided in at least one needle channel in the channel longitudinal direction.

At least one needle channel may also be called a knitting head. At least one slider needle may be displaceable in the needle channel in the needle longitudinal direction. At least one needle channel may comprise a bottom in the channel height direction. At least one needle channel may comprise an open top in the channel height direction. The beads of at least one slider needle may be arranged below the top in at least one needle channel.

At least one slider needle with the beads of its slider spring may be guided with room for maneuver in the at least one needle channel with the hook opening being open in the channel transverse direction. At least one slider needle may rest with the beads in the channel transverse direction when the hook opening is closed.

The spring longitudinal direction, the bead longitudinal direction, the slider longitudinal direction, the needle longitudinal direction, and the channel longitudinal direction may be at least approximately equivalent. The spring transverse direction, the bead transverse direction, the slider transverse direction, the needle transverse direction, and the channel transverse direction may be at least approximately equivalent. The spring height direction, the bead height direction, the slider height direction, the needle height direction, and the channel height direction may be at least approximately equivalent.

Additionally, the objective underlying the invention is attained in a method for the production of at least one such slider spring, with several slider springs being stacked such that respectively one convex bead exterior is received by one concave bead interior.

In summary, and in other words, a bead embodiment at the slider springs can therefore be learned from the invention, among other things. In order to produce these slider springs, with a pointy tool, such as a chisel, pressure can be applied to one side of the slider spring, causing an approximately triangular notch at the respective side, which usually extends in the longitudinal direction of the needle. At the opposite side, a largely rounded bead may form here. The groove-like embodiment forming here can be called a bead. Embodiments differing from a groove-like form, in which a recess is opposite to a bulging, may also be called beads. The beads may be produced such that in the assembled slider springs, the rounded bulges always point away from the needle, i.e. towards the "outside".

The distance, from maximum to maximum of the two rounded beads pointing outwardly at the two complementary slider springs, when the hook interior is open, i.e. as long as the hook is not engaging between the two slider springs, may be shorter than the width of the needle channel for which the respective slider needle is intended.

In case of a closed inner hook chamber, thus when the hook engages between the two slider springs and the slider springs are pushed apart, the distance of the two rounded beads may be approximately equivalent to the width of the needle channel. Only in case of a closed interior hook chamber, then the needle can rest with the beads of the slider springs at the side walls of the needle channel.

The bead can be formed such that a groove-like bending, a bead, develops, with the outwardly curved, convex bending/bead potentially being formed here such that it fits completely in the inwardly curved, concave bend. The slider springs can be stacked here.

The term "can" marks particular optional features of the invention. Accordingly, there is respectively an exemplary embodiment of the invention that comprises the respective feature or the respective features.

The invention increases the stiffness of the slider spring, particularly about a bending axis extending in the spring height direction. The ability to guide the slider needle in the needle channel is improved. A more precise guidance of the slider needle in the needle channel is possible. It is possible to support the slider spring in the needle channel when the hook opening is closed. A more precise loop formation is enabled. The production of textiles with an improved degree of fineness is possible. Load peaks are reduced. The operating life is increased. The expense, such as production expense, handling expense, storage expense, transportation expense, and/or logistics expense is reduced. It is possible or facilitated to stack slider springs. The stability of a stack of slider springs is improved. The separation of stacked slider springs is possible or facilitated.

In the following, exemplary embodiments of the invention are described in greater detail with reference to the figures. Additional features and advantages are discernible from this description. Concrete features of these exemplary embodiments may represent general features of the invention. Features of these exemplary embodiments connected to other features may also represent individual features of the invention.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
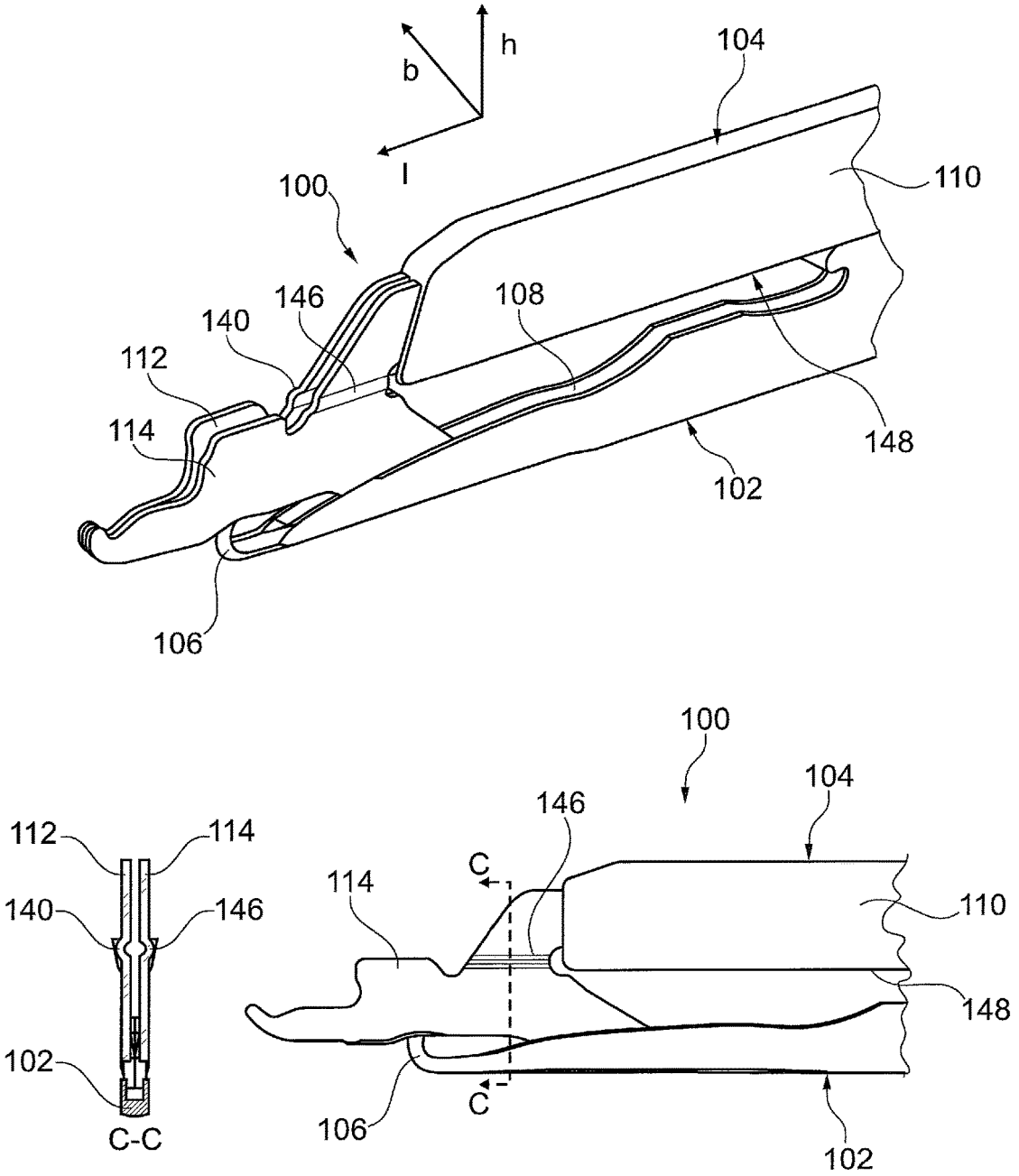
FIG. 1 depicts an exemplary slider needle for a knitting machine in a perspective view, in a side view, and in a cross-section along the line C-C.

FIG. 1 shows a detail of a slider needle 100 in a perspective view, in a side view, and in a cross-section along the line C-C. The slider needle 100 serves for the use in a knitting machine. The slider needle 100 comprises a needle body 102 and a slider 104.

The needle body 102 comprises a hook 106 and a slider channel 108. The slider channel 108 comprises two side walls, a bottom, and an open top. The slider channel 108 ends in the hook 106. The hook 106 comprises a hook opening and a hook tip. The hook 106 comprises an arc section of approximately 180 degrees.

The slider 104 comprises a slider body 110, a first slider spring 112, and a second slider spring 114. The slider 104 serves for opening and/or closing a hook opening. The slider 104 is displaceable in the longitudinal direction l in reference to the needle body 102. The slider 104 is guided in a fashion displaceable in the longitudinal direction l at the needle body 102. The slider 104 is displaceable in the longitudinal direction l between a first end position in which the hook opening is open, and a second end position in which the hook opening is closed.

Figure 2:
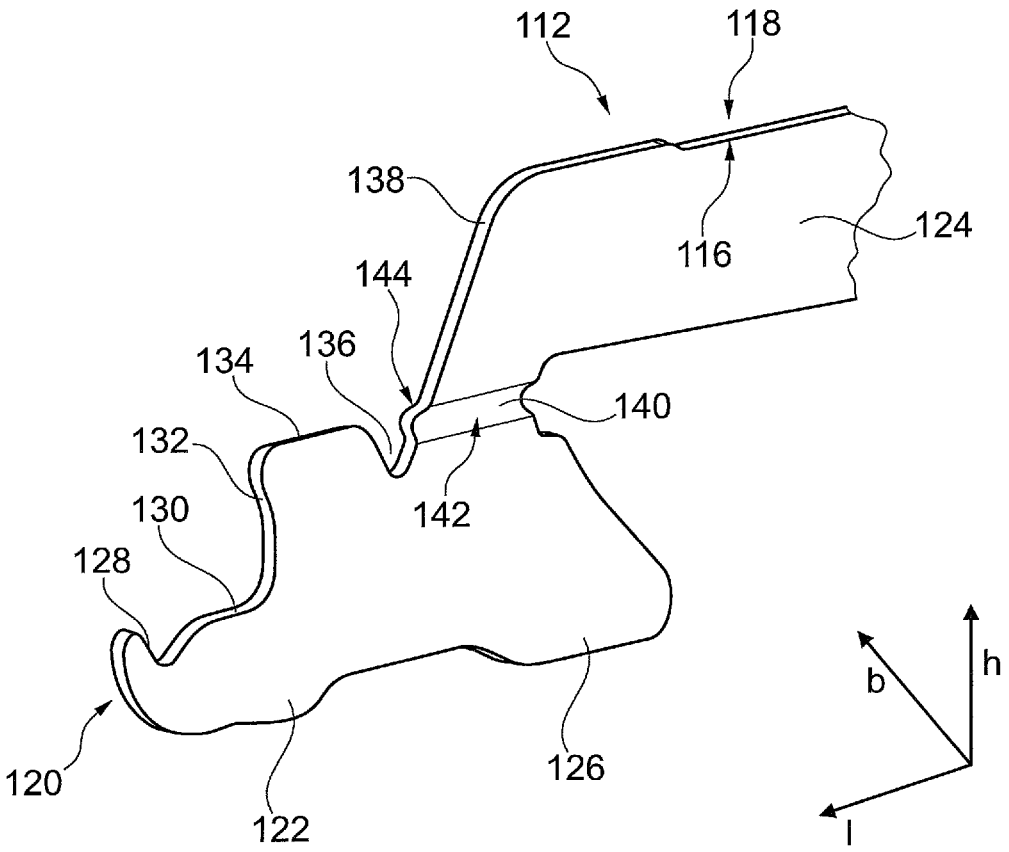
FIG. 2 depicts an exemplary slider spring with a bead.

FIG. 2 shows a detail of the first slider spring 112 as an individual part. In the following, the first slider spring 112 is described as an example. This description of the first slider spring 112 also refers to the second slider spring 114. The first slider spring 112 and the second slider spring 114 are embodied in a mirror-symmetrical fashion in reference to each other.

The slider spring 112 comprises a flat spring-like shape with a circumferential edge. In a transverse direction b, the slider spring 112 comprises a spring interior 116 and a spring exterior 118 opposite said spring interior 116. The slider spring 112 comprises in the height direction h a top and a bottom opposite said top. The slider spring 112 comprises in the longitudinal direction l a hook-side end 120. The slider spring 112 comprises a closing section 122. The closing section 122 serves for closing the hook opening. The closing section 122 is arranged at the hook-side end 120 and extends along the bottom. The slider spring 112 comprises a connecting section 124. The connecting section 124 serves for connecting the slider spring 112 to the slider body 110. The connecting section 124 is arranged at an end of the slider spring 112 opposite the hook-side end 120 in the longitudinal direction l. The slider spring 112 comprises a guide section 126. The guide section 126 serves for guiding the slider spring 112 at the needle body 102. The guide section 126 is arranged at the bottom of the slider spring 112. The guide section 126 comprises a runner-like shape. The guide section 126 is arranged adjacent to the closing section 122.

The circumferential edge of the slider spring 112 is contoured. The slider spring 112 comprises at its hook-side end 120 a cam-like shape with an end flank 128. Following the edge in the longitudinal direction l the slider spring 112 comprises at its top a loop support section 130, a support flank 132, a top edge 134, a recess 136, and a ramp section 138. The ramp section 138 transitions into the connecting section 124.

The first slider spring 112 comprises a bead 140. The bead 140 comprises a concave bead interior 142 and a convex bead exterior 144. The bead interior 142 is arranged at the spring interior 116. The bead exterior 144 is arranged at the spring exterior. The bead 140 is arranged in the height direction h in the proximity of the top edge 134. The bead 140 is arranged in the extension of the top edge 134. The recess is arranged between the top edge 134 and the bead 140. Sections of the slider spring 112 adjacent in the height direction h to the bead 140 are located in the transverse direction b in the same level.

The slider spring 112 is made from steel. The slider spring 112 comprises a reduced material thickness in the proximity of its bead 140 in the transverse direction b. The second slider spring 114 comprises a corresponding bead 146 in a mirror-symmetrical fashion.

The slider springs 112, 114 are initially produced separated from the slider body 110 and subsequently connected fixed to the slider body 110, for example by caulking or clipping. The slider springs 112, 114 are arranged side-by-side in the transverse direction b. The concave bead interiors, such as 142, of the slider springs 112, 114 point towards each other. The convex bead exteriors, such as 144, of the slider springs 112, 114 point outwardly in the transverse direction b. The slider springs 112, 114 are guided with their guide sections, such as 126, in the slider channel 108 in the longitudinal direction l.

The slider body 110 comprises a bottom edge 148 for guiding at the needle body 102. The beads 140, 146 of the slider springs 112, 114 are arranged in the proximity of the bottom edge 148 in the height direction h. The beads 140, 146 of the slider springs 112, 114 are arranged in the extension of the bottom edge 148.

The second end position shown in FIG. 1 engages the hook tip between the slider springs 112, 114 and pushes the slider springs 112, 114 elastically apart in the transverse direction b at the engagement area according to a width of the engaging hook tip. Due to the fact that the slider springs 112, 114 are clamped with their connecting sections, such as 124, at the slider body 110 and are arranged with their guide sections, such as 126, in the slider channel 108, the slider springs 112, 114 are pushed apart by a deviating width in other sections in the transverse direction b. In the first end position the hook tip is not engaging between the slider spring 112, 114 and the slider springs 112, 114 sectionally contact each other, if applicable in a stressed fashion.

The knitting machine in which the slider needle 100 is used comprises needle channels to receive slider needles, such as 100. The needle channels extend respectively in the longitudinal direction l and each comprise side walls, which limit the needle channel in the transverse direction b, a bottom which limits the needle channel in the height direction h towards the bottom, and an open top. When the slider needle 100 is arranged in a needle channel, the beads 140, 146 are arranged in the needle channel in the height direction h below the open top. The slider needle 100 is displaceable in the needle channel in the longitudinal direction l. The slider needle 100 and the corresponding needle channel, in which the slider needle 100 is arranged, form a guide arrangement. When the hook opening is open, the slider needle 100 is guided with room for maneuver in the needle channel in the transverse direction b. When the hook opening is closed the slider needle 100 rests with the beads 140, 146 in the needle channel in the transverse direction b.

Figure 3:
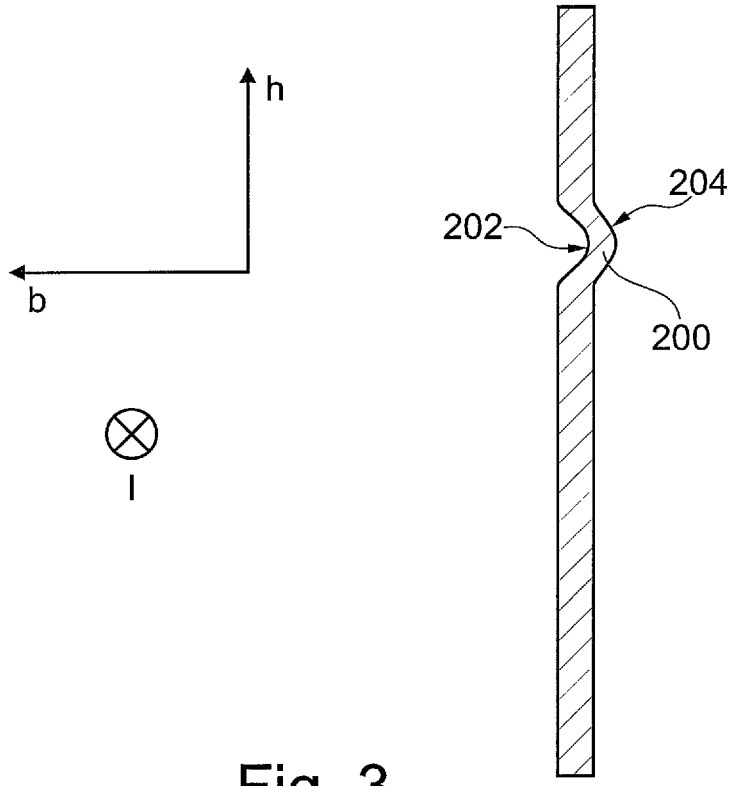
FIG. 3 depicts an exemplary bead of a slider spring with similar cross-sectional contours in a cross-sectional view.

FIG. 3 shows in a cross-sectional view a bead 200 of a slider spring, such as the slider spring 112, 114 according to FIG. 1 and FIG. 2 with similar cross-sectional contours. The bead interior 202 and the bead exterior 204 comprise similar cross-sectional contours. The bead interior 202 and the bead exterior 204 respectively comprise an arc-shaped cross-sectional contour. The concave bead interior 202 comprises an arc-shaped cross-sectional contour with a smaller radius. The convex bead exterior 204 comprises an arc-shaped cross-sectional contour with a greater radius. For the rest, reference is made additionally to FIGS. 1 and 2 as well as the corresponding description, in particular.

Figure 4:
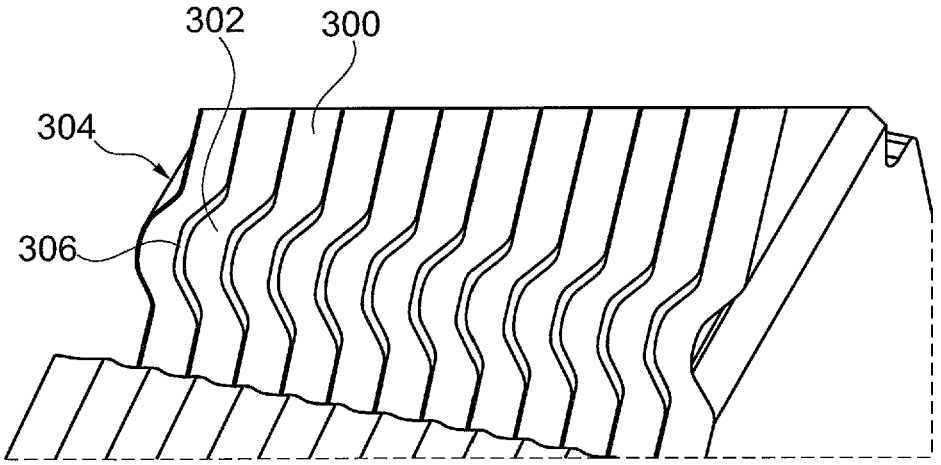
FIG. 4 depicts exemplary stacked slider springs.

FIG. 4 shows stacked slider springs, such as 300, such as slider springs 112, 114 according to FIGS. 1 and 2. The slider springs 300 comprise beads 302 with similar cross-sectional contours, such as bead 200 according to FIG. 3. Due to the beads 302 with similar cross-sectional contours the slider springs 300 can be stacked safely and in a stable fashion.

The slider springs 300 form a stack 304. The stack 304 is formed either only from first slider springs or only from second slider springs. The slider springs 300 are stacked with their circumferential edges in a superimposable fashion. The slider springs 300 are stacked with their beads nesting. Here, respectively one bead exterior is received by one bead interior.

Based on the material thickness being reduced in the transverse direction b between the stacked slider springs 300, such as 306, here channels form. The channels respectively comprise a sickle-shaped cross-section. The slider springs 300 are stacked for implementing production steps, for example for cleaning, for transportation, and/or for storage. The slider springs 300 are manually or automatically stacked.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

LIST OF REFERENCE CHARACTERS

100 slider needle
102 needle body
104 slider
106 hook
108 slider channel
110 slider body
112 first slider spring
114 second slider spring
116 spring interior
118 spring exterior
120 hook-side end
122 closing section
124 connecting section
126 guide section
128 end flank
130 loop support section
132 support flank
134 upper edge
136 recess
138 ramp section
140 bead
142 concave bead interior
144 convex bead exterior
146 bead
148 bottom edge
200 bead
202 concave bead interior
204 convex bead exterior
300 slider spring
302 bead
304 stack
306 channel

What is claimed is:

1. A slider spring for a slider used with a slider needle, the slider spring comprising:

a closing section for closing a hook opening of the slider needle;

a connection section for connecting to a slider body of the slider; and a guide section for guiding the slider spring at a needle body;

wherein the slider spring extends in a spring longitudinal direction, in a spring transverse direction, and in a spring height direction; and at least one groove-like shaped reinforcement bead with a concave bead interior and an oppositely disposed convex bead exterior;

the slider spring shaped and configured to be stacked against at least one other slider spring such that the convex bead exterior of the slider spring fits completely within the respective concave bead interior of the at least one other slider spring.

2. The slider spring of claim 1, wherein the bead interior and the bead exterior comprise at least approximately similar cross-sectional contours.

3. The slider spring of claim 1, wherein the bead interior and the bead exterior each comprise an arc-shaped cross-sectional contour.

4. The slider spring of claim 3, wherein the bead interior comprises an arc-shaped cross-sectional contour with a radius smaller than a radius of the arc-shaped cross-sectional contour of the bead exterior.

5. The slider spring of claim 1, wherein the slider spring comprises a reduced material thickness at least in a cross section of at least at one bead in the spring transverse direction.

6. A slider for a slider needle, the slider comprising:

a slider body extending in a slider longitudinal direction, in a slider transverse direction, and in a slider height direction;

a first slider spring; and a second slider spring;

the first and second slider springs configured according to claim 1.

7. The slider of claim 6, wherein the first slider spring and the second slider spring are shaped and configured at least approximately in a mirror-symmetrical fashion.

8. A slider needle for a loop-forming textile machine, the slider needle comprising:

a needle body including a hook and a slider channel, wherein the hook includes a hook opening;

the needle body extending in a needle longitudinal direction, in a needle transverse direction, and in a needle height direction; and a slider according to claim 6, wherein the slider is displaceable in the needle longitudinal direction relative to the needle body between a first position wherein the hook opening is in an open condition, and at least a second position wherein the hook opening is in a closed condition.

9. A guide arrangement for a loop-forming textile machine, the guide arrangement comprising:

at least one needle channel for a slider needle, the at least one needle channel extending in a channel longitudinal direction, in a channel transverse direction, and in a channel height direction; and at least one slider needle according to claim 8;

wherein the at least one slider needle is guided in the at least one needle channel in the channel longitudinal direction.

10. The guide arrangement of claim 9, wherein:

the at least one needle channel includes an open top in the channel height direction; and the respective beads of the first and second slider springs of the at least one slider needle are arranged in the at least one needle channel beneath the open top.

11. The guide arrangement of claim 9, wherein:

the respective beads of the first and second slider springs of the at least one slider needle are guided within the needle channel with free play in the channel transverse direction when the hook opening is in the open condition; and the respective beads of the first and second slider springs of the at least one slider needle contact the needle channel in the channel transverse direction when the hook opening is in the closed condition.

12. A method for producing a slider spring for a slider used with a slider needle, the method comprising:

obtaining at least one slider spring according to claim 1; and stacking the at least one slider spring against at least one other slider spring such that the convex bead exterior of the at least one slider spring fits completely within the respective concave bead interior of the at least one other slider spring.

* * * * *